US007666108B2

(12) United States Patent
Bryant et al.

(10) Patent No.: US 7,666,108 B2
(45) Date of Patent: Feb. 23, 2010

(54) GOLF CLUB HEAD AND METHOD OF MANUFACTURING

(75) Inventors: Leslie Bryant, Peoria, AZ (US); Anthony Serrano, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 44 days.

(21) Appl. No.: 11/934,865

(22) Filed: Nov. 5, 2007

(65) Prior Publication Data

US 2009/0118036 A1 May 7, 2009

(51) Int. Cl.
*A63B 53/06* (2006.01)

(52) U.S. Cl. ..... 473/288; 473/341; 473/342

(58) Field of Classification Search ..... 473/288, 473/342, 348, 349, 340–341, 325
See application file for complete search history.

(56) References Cited

U.S. PATENT DOCUMENTS 1,355,889 A 10/1920 Campbell
4,872,685 A 10/1989 Sun
4,883,275 A 11/1989 Boone
5,458,332 A * 10/1995 Fisher ..... 473/251
5,542,675 A 8/1996 Micciche et al.
5,575,472 A 11/1996 Magerman et al.
5,938,543 A 8/1999 McGeeney et al.
5,951,412 A 9/1999 Rose et al.
6,692,376 B2 2/2004 Kosovac et al.
6,860,820 B2 * 3/2005 Specht ..... 473/312
6,971,960 B2 * 12/2005 Dewanjee et al. ..... 473/340
7,037,211 B1 5/2006 Kosovac
7,083,525 B2 8/2006 Pond et al.
2002/0094883 A1 * 7/2002 Chuang ..... 473/332
2004/0266548 A1 * 12/2004 Cheng et al. ..... 473/342

* cited by examiner

*Primary Examiner*—Stephen L. Blau

(57) ABSTRACT

A golf club head is composed of a first body having mass concentrations at the heel and toe ends joined by a relatively thinner central web portion that is recessed from the front, top and rear surfaces of the club head. A second body member selected from a plurality of second body members composed of a relatively less dense material is temporarily attached to the web portion of the first body to form a face portion that extends from the sole to the top rail of the club as well as the central portion of the top rail.

21 Claims, 7 Drawing Sheets

GOLF CLUB HEAD AND METHOD OF MANUFACTURING

FIELD OF THE INVENTION

The present invention relates generally to golf equipment and in particular to putters with inserts.

DRAWINGS

DESCRIPTION

Figure 1:
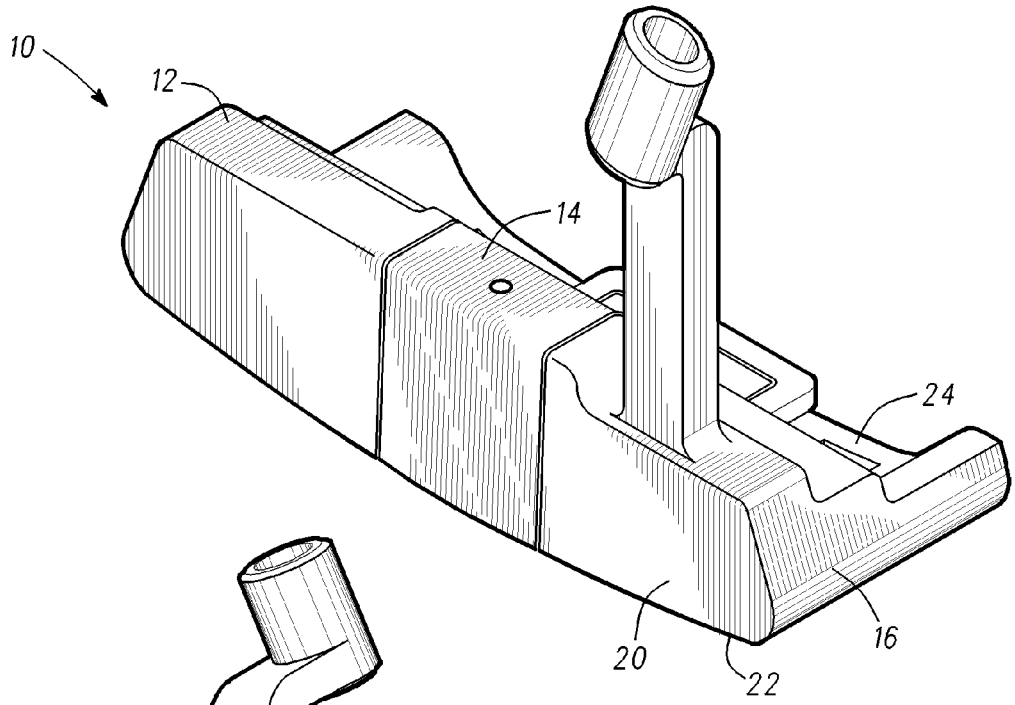
FIG. 1 is a front perspective view of an illustrative embodiment of putter head incorporating features of the present invention.
Figure 2:
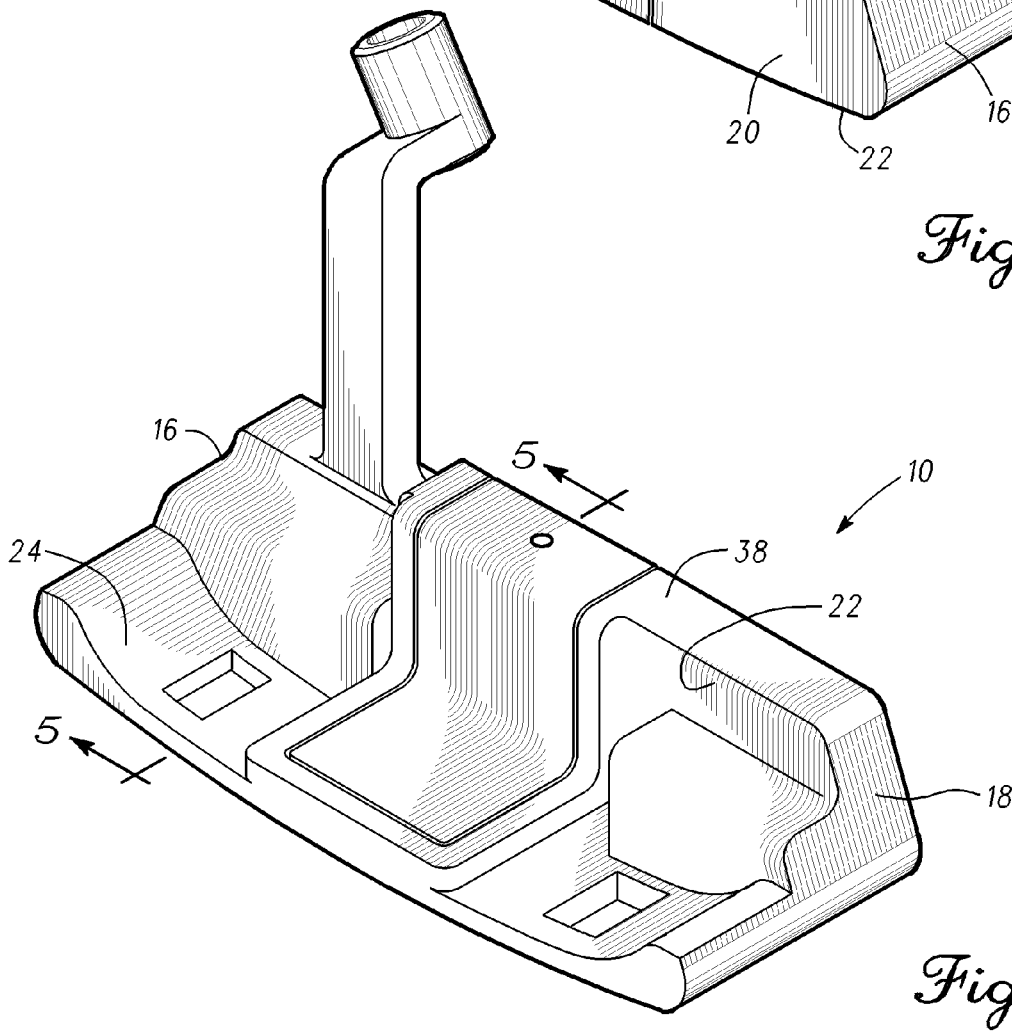
FIG. 2 is a rear perspective view of the putter head of FIG. 1.

With reference to FIGS. 1-6, a golf club head 10 comprises a first body member 12 and a second body member 14. For example, first body member 12 may be made of a metallic material such as stainless steel and/or any other suitable materials. First body member 12 includes a heel end 16, a toe end 18, a forward surface 20, a rearward surface 22 and a rear extension 24. Heel end 16 of first body member 12 further includes a hosel 26 having a hosel bore 28 adapted for receiving a golf club shaft (not shown).

Figure 3:
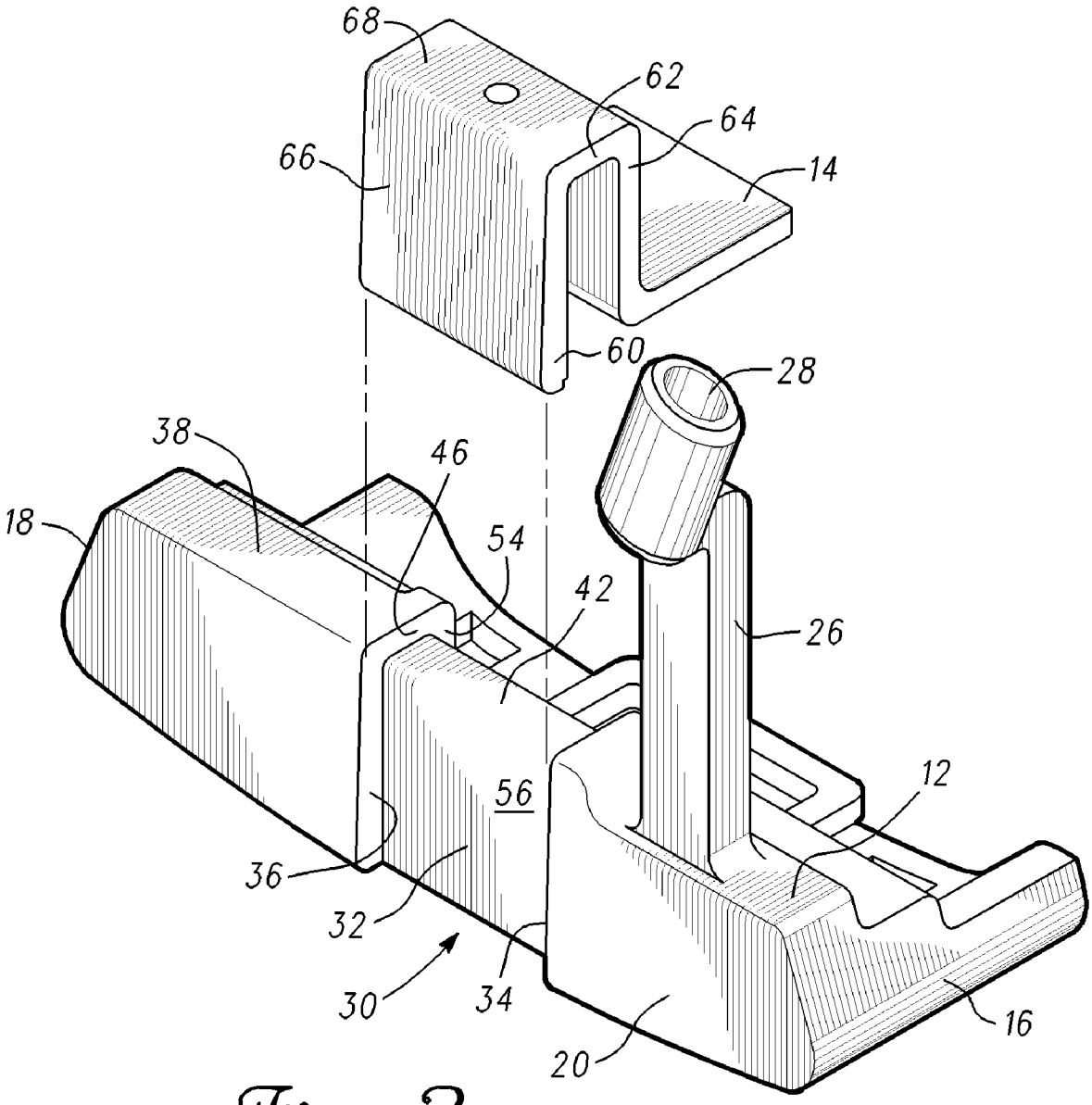
FIG. 3 is an exploded front perspective view of the putter head of FIG. 1.
Figure 4:
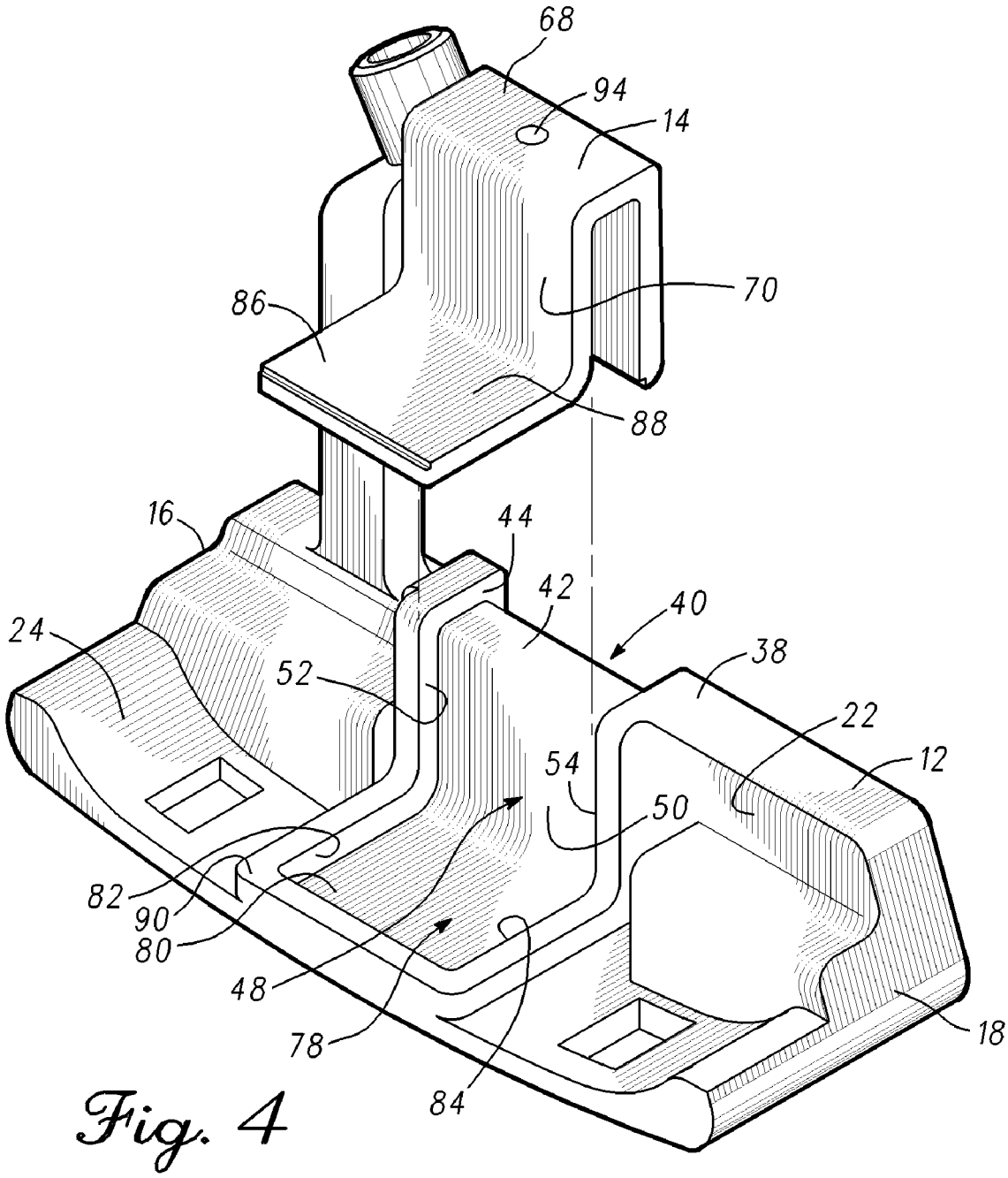
FIG. 4 is a rear perspective view of the putter head of FIG. 1.

With particular reference to FIGS. 3 and 4, forward surface 20 of first body member 12 includes a recessed portion 30 having a recessed surface 32, a near side wall 34 and a far side wall 36. top rail 38 of first body 12 also includes a recessed portion 40 defined by a recessed surface 42, a near side wall 44 and a far side wall 46.

Rearward surface 22 of first body member 12 also includes a recessed portion 48 defined by a recessed surface 50, a near side wall 52 and a far side wall 54. Recessed surfaces 32, 42 and 50 are of equal depth below front surface 20, top rail 38 and rearward surface 22, respectively. Therefore recessed surfaces 32, 42 and 50 cooperate to form a relatively thin web portion 56 joining the relatively thicker mass concentrations at heel end 16 and toe end 18 of first body member 12. For example, the depth of the recessed portions can be from 0.100 to 0.250 inches. In one example, web portion 56 may have a thickness between recessed surfaces 32 and 50 of from 0.200 to 0.450 inches.

Second body member 14 is attached to first body member 12 as discussed more fully hereinafter. Second body member 14 has a substantially upright front flange portion 60 having a thickness equal to the depth of recessed portion 30, a horizontally extending flange portion 62 having a thickness equal to the depth of recessed portion 40 and a rear flange portion 64 having a thickness equal to the depth of recessed portion 48.

Accordingly, when second body member 14 is placed over web portion 56, forward surface 66 of second body member 14 is substantially coplanar with forward surface 20 of first body member 12. Similarly, the upper surface of intermediate portion 68 and the outer surface of rear portion 70 of second body member 14 are coplanar with their respective adjoining top rail 38 and rearward surfaces 22 of first body member 12.

In one example, second body member 14 comprises a relatively lower density material such as a polymer. In another example, second body member 14 is an injection molded thermoplastic such as thermoplastic polyurethane or cellulose acetate propionate. In particular, second body member 14 may be formed of a thermoplastic polyurethane having a hardness of between 50 Shore D and 80 Shore D. Alternatively, second body member 14 may be formed of thermoplastic polyurethane having a hardness of approximately 72 Shore D. The methods and apparatus described herein are not limited in this regard.

As can be determined from the foregoing, providing a thin web portion 56 joining the relatively more massive heel and toe portions of first body member 12 increases the perimeter weighting of the club head over other insert putters in which the insert is poured or placed into a cavity formed in the metallic portion of the club head. Moreover, because second body member 14 extends across the full height of golf club head 10 from sole 72 to top rail 38, there is no metallic rim surrounding nonmetallic second body member 14. Accordingly, only second body member 14 will contact the golf ball even if the ball is struck high or is struck low, thereby leading to more consistent performance of the putter in use.

In the illustrative embodiment of FIGS. 1-6, second body member 14 is temporarily attached to first body. As used herein, temporarily attached, means that second body member 14 may be removed (e.g. by prying) from first body member 12 without destroying second body member 14 or damaging first body member 12 as would be the case if second body member 14 were removed by sawing, drilling, milling, etc. The means for temporarily attaching second body member 14 to first body member 12 are also integral either to second body member 14 or first body member 12, As used herein, "integral" means that the attachments are either imbedded in or cast as feature(s) on second body member 14 or first body member 12 or are otherwise permanently affixed to second body member 14 or first body member 12 as opposed to threaded fasteners, rivets and other separate fasteners.

Figure 7:
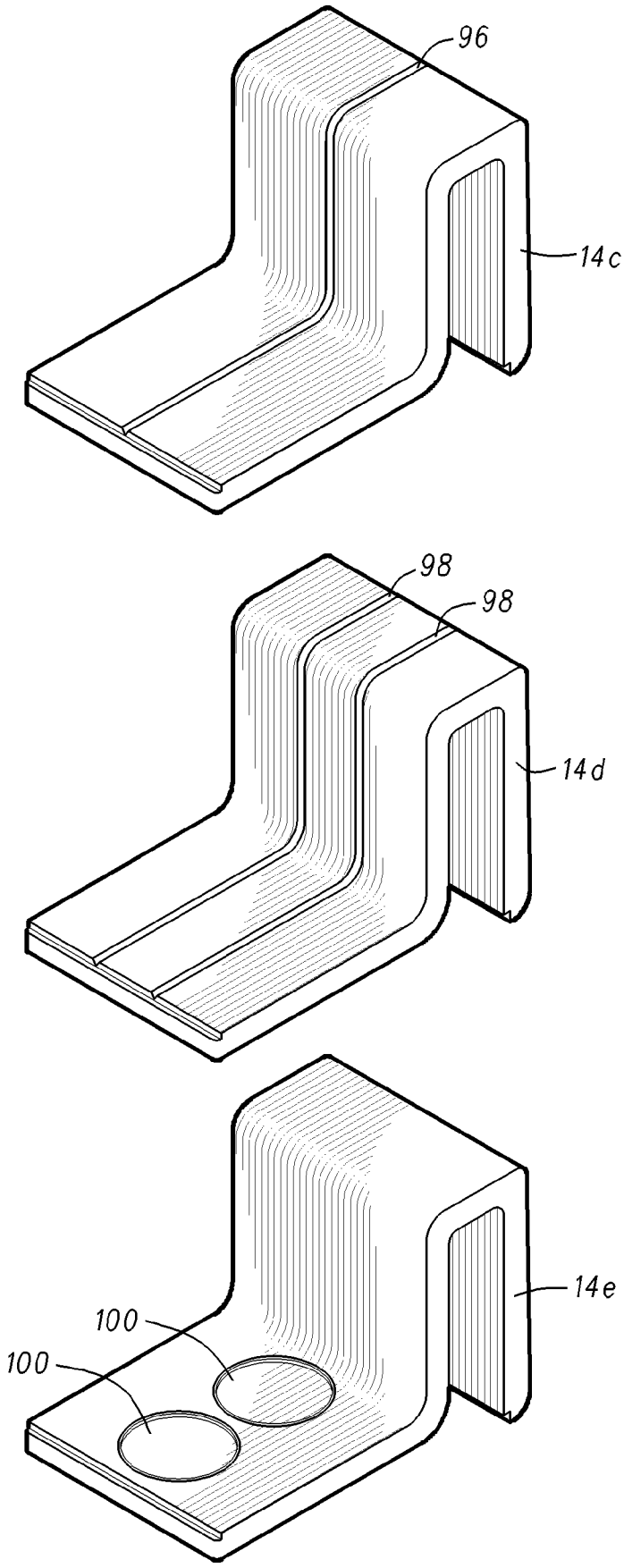
FIG. 7 is a rear perspective view of a plurality of second body members associated with the putter head of FIG. 1.

In the illustrative embodiment, second body member 14 is retained to first body member 12 by one or more detents 92 formed on first body member 12, which engage corresponding recesses in second body member 14, either alone or in combination with adhesive tape, which prevents second body member 14 rattling against first body member 12 when the club is struck. This feature allows one of a plurality of second body members 14*c*, 14*d*, 14*e* as shown in FIG. 7 to be affixed to a given first body member, either by the manufacturer or the user may select one of a plurality of second body members 14*c*, 14*d*, 14*e* supplied as a kit to enable post-sale interchangeability of second body members 14*c*, 14*d*, 14*e* to suit the user's taste. The plurality of second body members 14*c*, 14*d*, 14*e*, may be made of different materials to provide a different feel or sound to suit the user's taste. Additionally, since some users prefer a traditional alignment aid such as a small circular dot 94 on the top rail of the club, while other users prefer more elaborate alignment aids, such as single lines 96, parallel lines 98, large circles 100, or chevrons, etc. and may prefer different colored second body members to contrast with the color of first body member 12, the plurality of second body members 14*c*, 14*d*, 14*e*, may have different colors and/or different alignment indicia appearing on their respective upper surfaces.

Figure 8:
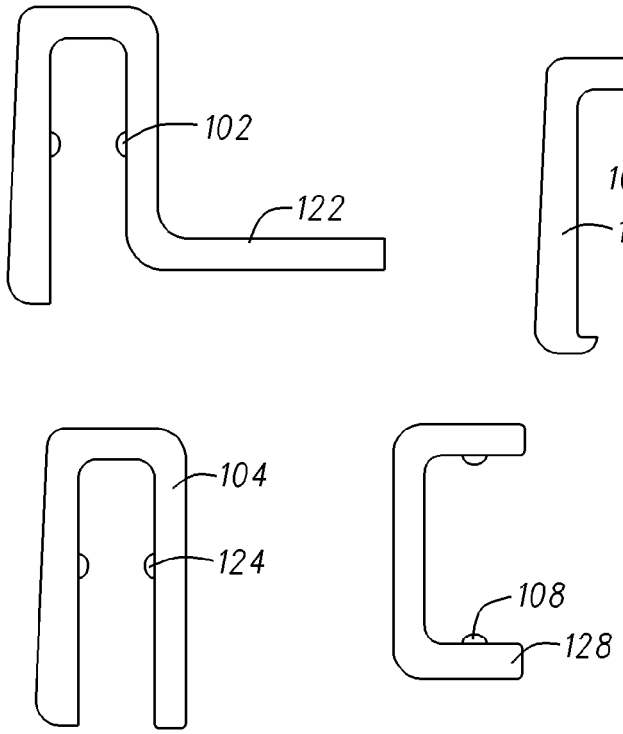
FIG. 8 is a side view of alternative embodiments of a second body member incorporating features of the present invention.

Alternatively, as shown in FIG. 8, second body member 122 may be retained to first body member by detents 102 formed on the surface of second body member 122, which engage corresponding recesses formed in first body member 12. Additionally, although the second body member may be formed with a cross-section in the shape of a question mark as with second body member 122, second body member is not limited to question mark shapes, but may have a U-shaped cross section as with second body 124, which includes detents 104, an L-shaped cross section as with second body 126, which includes a hook-shaped detent 106, a C-shaped cross section as with second body 128, which includes detents 108, or any other suitable cross section and integral means for temporarily attaching a second body to a first body.

In the illustrative embodiment, rear extension 24 of first body member 12 also includes a recessed portion 78 defined by a recessed surface 80, a near side wall 82 and a far side wall 84. Second body member 14 has a corresponding rear projection 86 having a thickness equal to the depth of recessed portion 78 so that when second body member is in place, top surface 88 is flush with upper surface 90 of rear extension 24. The upper surface of intermediate portion 68 and top surface of rear projection 88 of second body member 14 are inherently contrasting in color and/or surface finish compared to first body member 12. Accordingly, the surfaces cooperate to form a natural alignment aid to assist the golfer with aligning forward surface 66 of second body member 14 with the golf ball to be putted.

Figure 5:
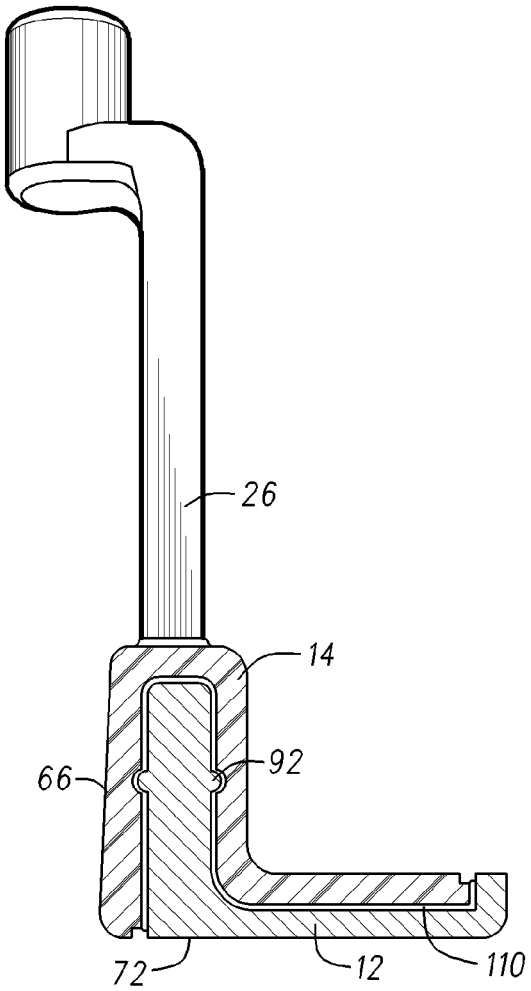
FIG. 5 is a cross-sectional view of the putter head of FIG. 2 taken along line 5-5.
Figure 6:
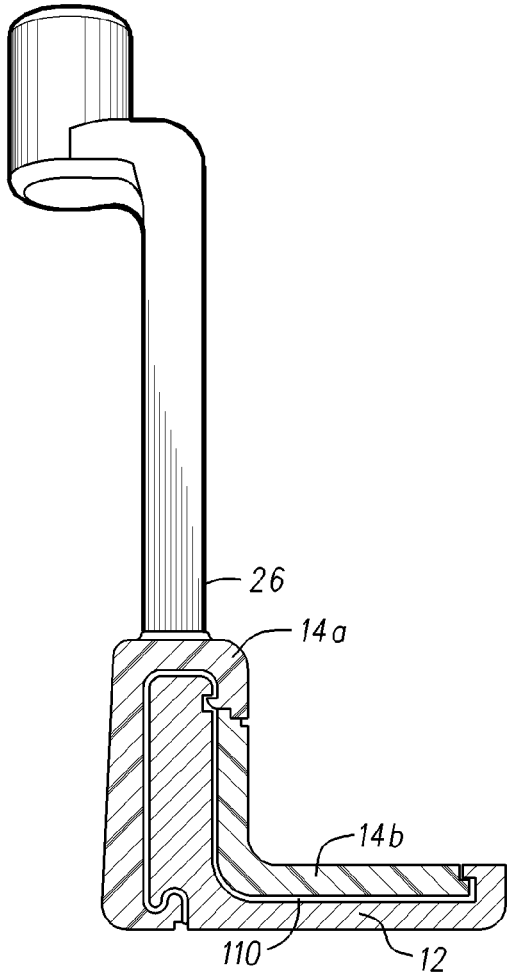
FIG. 6 is a cross-sectional view of an alternative embodiment of a putter head incorporating features of the present invention.

As shown in FIG. 5, in the illustrative embodiment second body member 14 is a unitary member attached to first body member 12 by a combination of detents and a conventional adhesive such as a thermoset epoxy 110 disposed in the gap between first body member 12 and second body member 14. Alternatively, as shown in FIG. 6, second body member 14 is composed of two parts 14*a* and 14*b* which interlock mechanically with first body member 12 to retain second body members 14*a* and 14*b* either alone or as supplemented by adhesive layer 110.

As noted above, second body member 14 may be temporarily coupled to first body member 12 with detents to allow interchangeability of the alignment indicia and/or color associated with golf club head 10. Alternatively, second body member 14 may be temporarily coupled to first body member 12 via one or more alternative temporary attachment devices such as hook and loop fasteners or magnetic devices. In an illustrative embodiment, first body member 12 is made of a ferrous material and second body member 14 includes one or more magnetic devices embedded within second body member 14. Alternatively, first body member is made of a non ferrous material and first body member may have imbedded magnets or imbedded ferrous targets to attract the magnets imbedded in second body member 14. The methods, apparatus, and articles of manufacture described herein are not limited in this regard.

Figure 9:
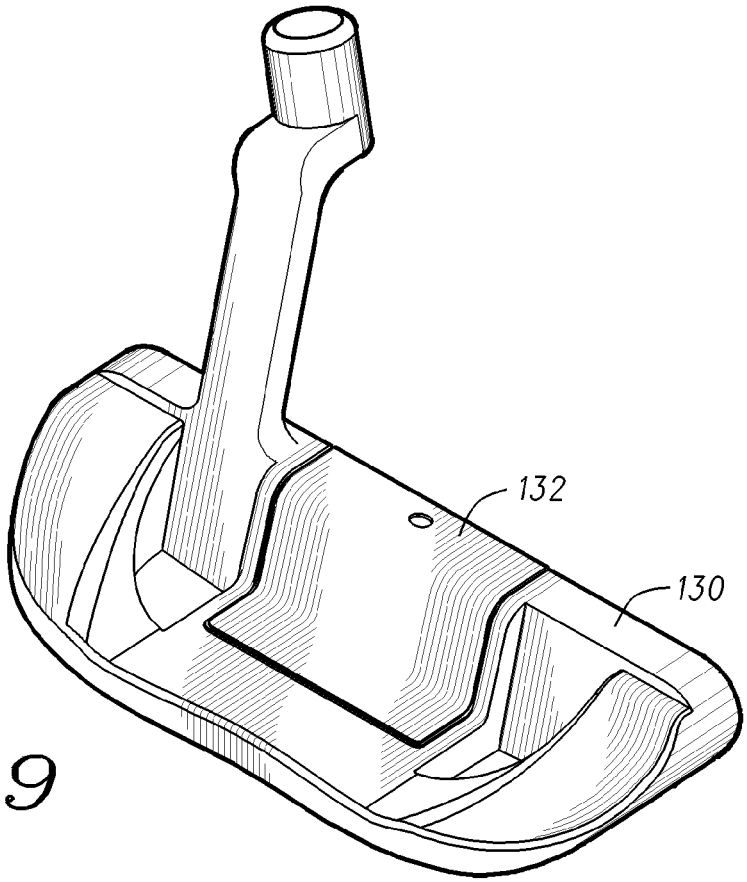
FIG. 9 is a rear perspective view of an alternative embodiment of a first body member.
Figure 10:
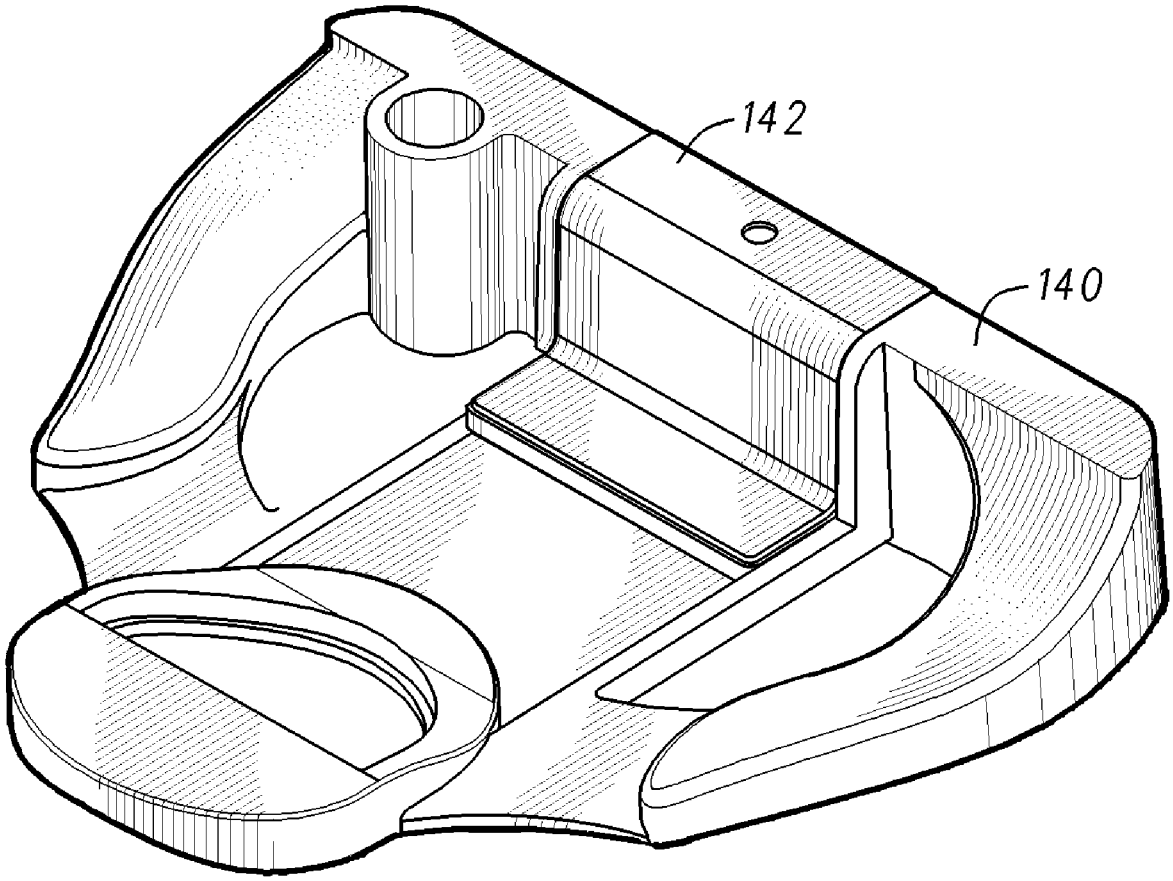
FIG. 10 is a rear perspective view of an additional alternative embodiment of a first body member.

Although the above examples may describe and depict first and second body members with particular configurations, shapes, sizes, and/or materials, the methods, apparatus, and articles of manufacture described herein may include first and second body members with other suitable configurations, shapes, sizes, and/or materials, such as first body 130 together with second body member 132 as shown in FIG. 9, and first body 140 together with second body 142. Further while the above examples may describe and depict putter-type club head, the methods, apparatus, and articles of manufacture described herein may be applicable to driver-type club heads, fairway wood-type club heads, hybrid-type club heads, iron-type club heads, and/or other suitable types of golf club heads. In addition, the methods, apparatus, and articles of manufacture may be applicable other sport equipment (e.g., a baseball bat, a hockey stick, etc.) or pieces of hardware to strike an object (e.g., a hammer, a mallet, etc.). The methods, apparatus, and articles of manufacture described herein are not limited in this regard.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. A golf club head comprising:

A club head body comprising a first body member and a second body member;

said first body member being formed of a first material having a heel end, a toe end, a sole, a forward surface, an upper surface, and a rear surface, the forward surface of said first body member comprising raised portions proximal the heel and toe ends and a first recessed portion intermediate the heel and toe ends, the first recessed portion having a first predetermined depth, the first recessed portion being defined by a first near side wall adjacent the heel end, a first far side wall adjacent the toe end and a first recessed surface extending between the first near side wall and the first far side wall;

the upper surface of said first body member comprising raised portions proximal the heel and toe ends and a second recessed portion intermediate the heel and toe ends, the second recessed portion having a second predetermined depth, the second recessed portion being defined by a second near side wall adjacent the heel end, a second far side wall adjacent the toe end and a second recessed surface extending between the second near side wall and the second far side wall;

said second body member comprising a body formed of a second material, said second body member being temporarily attached to said first body member with an inner surface of said second body member disposed adjacent the first and second recessed surfaces, said second body member having a vertical flange portion with an outer surface extending between the raised portions of the forward surface and a horizontal flange portion extending between the raised portions of the upper surface of the first body member, said second body member forming a continuous, substantially flat front striking surface and at least a portion of a top rail of said golf club head.

2. The golf club head of claim 1, wherein:

said first recessed portion is devoid of an upper side wall that extends to the front face of the club head body, whereby the second body member extends continuously from the front surface to the top rail.

3. The golf club head of claim 1, wherein:

the first material is more dense than the second material.

4. The golf club head of claim 1, wherein:

said second body member is selected from a plurality of second body members, wherein plural of said plurality of second bodies have different alignment markings applied thereto.

5. The golf club head of claim 1, wherein:

the horizontal flange portion of said second body member has an outer surface coplanar with the raised portion of the top rail.

6. The golf club head of claim 1, wherein:

the rear surface of said first body member comprises raised portions proximal the heel and toe ends and a third recessed portion intermediate the heel and toe ends, the third recessed portion having a third predetermined depth, the third recessed portion being defined by a third near side wall adjacent the heel end, a third far side wall adjacent the toe end and a third recessed surface extending between the third near side wall and the third far side wall, wherein said first second and third recessed surfaces form a substantially upright central web disposed between the relatively thicker heel and toe ends of said first body member.

7. The golf club head of claim 6, wherein:

said second body member further comprises a rear portion having an inner surface adjacent the third recessed surface and an outer surface extending between the raised portions of the rear surface.

8. The golf club head of claim 6, wherein:

the height of said central web is at least as great at the thickness of said central web.

9. The golf club head of claim 6, wherein:

the central web has a thickness of no more than 0.450 inch.

10. The golf club head of claim 6, wherein:

the central web has a thickness of from 0.200 to 0.450 inch.

11. The golf club head of claim 6, wherein:

said first body member further comprises a rear extension extending substantially horizontally rearward from the rear surface of said first body member, the rear extension comprising raised portions proximal the heel and toe ends and a fourth recessed portion intermediate the heel and toe ends, the fourth recessed portion having a fourth predetermined depth, the fourth recessed portion being defined by a fourth near side wall adjacent the heel end, a fourth far side wall adjacent the toe end and a fourth recessed surface joining the fourth near side wall and the fourth far side wall, and wherein, said second body member further includes substantially horizontally projecting flange having an upper surface and a lower surface, the lower surface of the projection being disposed adjacent to the fourth recessed surface and the upper surface extending between the raised portions of said rear extension.

12. The golf club head of claim 1, wherein:

the first recessed surface is devoid of a lower side wall; and the front surface of the second body member extends to the sole of said first body member.

13. The golf club head of claim 1, further comprising:

at least one detent for temporarily attaching said second body member to said first body member.

14. The golf club head of claim 1, further comprising:

a magnet operatively disposed between the second body member and the third body member for temporarily securing said second body member to said first body member.

15. A golf club head comprising:

A club head body comprising a first body member and a second body member;

said first body member being formed of a first material having a heel end, a toe end, a sole, a front surface, an upper surface, and a rear surface, the front surface of said first body member comprising raised portions proximal the heel and toe ends and a first recessed portion intermediate the heel and toe ends, the first recessed portion having a first predetermined depth, the first recessed portion being defined by a first near side wall adjacent the heel end, a first far side wall adjacent the toe end and a first recessed surface extending between the first near side wall and the first far side wall;

the upper surface of said first body member comprising raised portions proximal the heel and toe ends and a second recessed portion intermediate the heel and toe ends, the second recessed portion having a second predetermined depth, the second recessed portion being defined by a second near side wall adjacent the heel end, a second far side wall adjacent the toe end and a second recessed surface extending between the second near side wall and the second far side wall;

said second body member comprising a body formed of a second material, said second body member being attached to said first body member with an inner surface of said second body member disposed adjacent the first and second recessed surfaces, said second body member comprising a vertical flange portion having a lower end, an upper end, and an outer surface extending between the raised portions of the forward surface, said second body member further comprising a horizontal flange portion attached to the upper end of the vertical flange portion and extending between the raised portions of the upper surface of said first body member, said second body member forming a continuous, substantially flat front striking surface and at least a portion of a top rail of said golf club head, wherein said second body member is substantially "question mark" shaped in cross section viewed from the heel end toward the toe end.

16. A club head body comprising:

a first body member and a second body member;

said first body member being formed of a first material having a heel end, a toe end, a sole, a front face, and a rear wall, the front face having a lower edge and an upper edge, the rear wall having an upper edge, said first body member further comprising a top rail joining the upper edge of the front face to the upper edge of the rear wall, said first body member further comprising a central channel extending substantially vertically from a lower surface of the front face to an upper surface of the front face and substantially horizontally across the top rail to an upper edge of the rear wall, the central channel having a predetermined depth;

said second body member adapted to be received into the central channel of said first body member, said second body member having a thickness corresponding to the predetermined depth of the central channel and an outer surface cooperating with the front face of said first body member to form a substantially planar front striking surface adapted to strike a golf ball and a substantially planar top rail surface adapted to act as a visual alignment aid, wherein said first body member further comprises a rear extension extending substantially horizontally rearward from the rear wall and wherein the central channel extends substantially horizontally from the rear wall to a rear edge of the rear extension.

17. The club head body of claim 16, wherein:

the rear wall further comprises a lower edge and wherein the central channel extends substantially vertically from the upper edge of the rear wall to the lower edge of the rear wall.

18. The club head body of claim 16, wherein:

the predetermined depth of the central channel is from 0.100 to 0.250 inch.

19. A club head body comprising:

a first body member and a second body member;

said first body member being formed of a first material having a heel end, a toe end, a sole, a front face, and a rear wall, the front face having a lower edge and an upper edge, the rear wall having an upper edge, said first body member further comprising a top rail joining the upper edge of the front face to the upper edge of the rear wall, said first body member further comprising a central channel extending substantially vertically from a lower surface of the front face to an upper surface of the front face and substantially horizontally across the top rail to an upper edge of the rear wall, the central channel having a predetermined depth;

said second body member adapted to be received into the central channel of said first body member, said second body member having a thickness corresponding to the predetermined depth of the central channel and an outer surface cooperating with the front face of said first body member to form a substantially planar front striking surface adapted to strike a golf ball and a substantially planar top rail surface adapted to act as a visual alignment aid wherein:

said second body member is temporarily attached to said first body member.

20. The club head body of claim 19, wherein:

said second body member is temporarily attached to said first body member by means of integral fasteners formed in one of said first body member and said second body member.

21. A golf club head comprising:

A club head body comprising a first body member and a second body member;

said first body member being formed of a first material having a heel end, a toe end, a sole, a forward surface, an upper surface, and a rear surface, the forward surface of said first body member comprising raised portions proximal the heel and toe ends and a first recessed portion intermediate the heel and toe ends, the first recessed portion having a first predetermined depth, the first recessed portion being defined by a first near side wall adjacent the heel end, a first far side wall adjacent the toe end and a first recessed surface extending between the first near side wall and the first far side wall;

the upper surface of said first body member comprising raised portions proximal the heel and toe ends and a second recessed portion intermediate the heel and toe ends, the second recessed portion having a second predetermined depth, the second recessed portion being defined by a second near side wall adjacent the heel end, a second far side wall adjacent the toe end and a second recessed surface extending between the second near side wall and the second far side wall;

said second body member comprising a body formed of a second material, said second body member being temporarily attached to said first body member with an inner surface of said second body member disposed adjacent the first and second recessed surfaces, said second body member having a vertical flange portion with an outer surface extending between the raised portions of the forward surface and a horizontal flange portion extending between the raised portions of the upper surface of said first body member, said second body member forming a continuous, substantially flat front striking surface and at least a portion of a top rail of said golf club head, wherein the rear surface of said first body member further comprises raised portions proximal the heel and toe ends and a third recessed portion intermediate the heel and toe ends, the third recessed portion having a third predetermined depth, the third recessed portion being defined by a third near side wall adjacent the heel end, a third far side wall adjacent the toe end and a third recessed surface extending between the third near side wall and the third far side wall, wherein said first second and third recessed surfaces form a substantially upright central web disposed between the relatively thicker heel and toe ends of said first body member, wherein said first body member further comprises a rear extension extending substantially horizontally rearward from the rear surface of said first body member, the rear extension comprising raised portions proximal the heel and toe ends and a fourth recessed portion intermediate the heel and toe ends, the fourth recessed portion having a fourth predetermined depth, the fourth recessed portion being defined by a fourth near side wall adjacent the heel end, a fourth far side wall adjacent the toe end and a fourth recessed surface joining the fourth near side wall and the fourth far side wall, and wherein said second body member further includes substantially horizontally projecting flange having an upper surface and a lower surface, the lower surface of the projection being disposed adjacent to the fourth recessed surface and the upper surface extending between the raised portions of said rear extension.

* * * * *